US011502389B2

(12) United States Patent
Lin et al.

(10) Patent No.: US 11,502,389 B2
(45) Date of Patent: Nov. 15, 2022

(54) ANTENNA WINDOWS IN CARBON FIBER ENCLOSURES

(71) Applicant: Hewlett-Packard Development Company, L.P., Spring, TX (US)

(72) Inventors: Chien-Ting Lin, Taipei (TW); Chi Hao Chang, Taipei (TW); Kuan-Ting Wu, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/976,495

(22) PCT Filed: Apr. 24, 2018

(86) PCT No.: PCT/US2018/029066
§ 371 (c)(1),
(2) Date: Aug. 28, 2020

(87) PCT Pub. No.: WO2019/209263
PCT Pub. Date: Oct. 31, 2019

(65) Prior Publication Data
US 2021/0143524 A1 May 13, 2021

(51) Int. Cl.
*H01Q 1/22* (2006.01)
*H01Q 1/36* (2006.01)
*H01Q 1/48* (2006.01)

(52) U.S. Cl.
CPC ..... *H01Q 1/2266* (2013.01); *H01Q 1/364* (2013.01); *H01Q 1/48* (2013.01)

(58) Field of Classification Search
CPC ..... B32B 2262/106; B32B 9/005; H05K 5/0217; H01Q 1/422; H01Q 1/2266; H01Q 1/364; H01Q 1/48
See application file for complete search history.

(56) References Cited

U.S. PATENT DOCUMENTS

| | | | | |
|---|---|---|---|---|
| 8,576,372 | B2 | 11/2013 | Ji et al. | |
| 9,608,308 | B2 | 3/2017 | Song et al. | |
| 9,653,777 | B2 | 5/2017 | Guterman et al. | |
| 9,680,202 | B2 | 6/2017 | Irci et al. | |
| 2009/0130995 | A1 | 5/2009 | Wang | |
| 2010/0315299 | A1 | 12/2010 | Bibl et al. | |
| 2013/0147079 | A1* | 6/2013 | Ji | B29C 45/0001 264/105 |
| 2013/0147330 | A1 | 6/2013 | Difonzo et al. | |
| 2013/0321216 | A1 | 12/2013 | Jervis et al. | |
| 2014/0272292 | A1* | 9/2014 | Yu | B29C 45/0001 428/141 |

(Continued)

FOREIGN PATENT DOCUMENTS

| | | |
|---|---|---|
| CN | 103132203 | 6/2013 |
| CN | 103660430 | 3/2014 |

*Primary Examiner* — Ricardo I Magallanes
(74) *Attorney, Agent, or Firm* — Tong, Rea, Bentley & Kim LLC

(57) ABSTRACT

In example implementations, an enclosure is provided. The enclosure includes a first layer of carbon fiber and a second layer of a carbon fiber pattern fabricated from a plastic. The first layer of carbon fiber is formed in a shape of a portable electronic device. An antenna window is formed in the first layer of the carbon fiber. The second layer of the carbon fiber pattern has a same shape and a same size as the first layer of carbon fiber.

18 Claims, 5 Drawing Sheets

(56) References Cited

U.S. PATENT DOCUMENTS

2014/0361932 A1* 12/2014 Irci ..... H01Q 21/28
343/702
2014/0375511 A1* 12/2014 Song ..... H01Q 1/241
343/702
2016/0302319 A1* 10/2016 Ferretti ..... H04M 1/0202

* cited by examiner

100

ANTENNA WINDOWS IN CARBON FIBER ENCLOSURES

BACKGROUND

Portable computing devices, such as laptop computers, may include various electrical components that are enclosed by a housing or an enclosure. The housing may provide protection to the components of the portable computing device. The electrical components may include devices such as processors, circuit boards, graphical processors, memory devices, interface cards, antennas, and the like.

DETAILED DESCRIPTION

Examples described herein provide carbon fiber enclosures with an antenna window. As discussed above, portable computing devices may have various electrical components that are enclosed by a housing or an enclosure. Some devices use a carbon fiber enclosure that provides a benefit of a strong outer protective shell, but having a light weight.

However, the carbon fiber material may be conductive. As a result, the carbon fiber enclosure can interfere with operation of wireless antennas inside of the carbon fiber enclosure. For example, the wireless antenna signals may be blocked or reduced by the carbon fiber enclosure. As a result, the operational range of the wireless antennas, or the overall functionality of the wireless antennas inside of the carbon fiber enclosure may be reduced.

Some previous solutions have used non-conductive materials in combination with the carbon fiber enclosure. For example, non-conductive materials may be located around a perimeter of a housing formed of the carbon fiber material. Consumers may prefer the feel and look of a total carbon fiber enclosure. The general application of non-conductive materials around a perimeter with the carbon fiber enclosure may not provide the same look as the all carbon fiber enclosure. Some solutions may paint the surface to hide the non-conductive materials. However, painting the surface may not provide the same feel and look of an all carbon fiber enclosure.

Examples herein provide a carbon fiber enclosure that includes an antenna window to prevent interference of the wireless antenna signals by the carbon fiber enclosure. For example, the antenna window may allow clear transmission and reception of wireless signals. The antenna window may have a variety of different shapes and dimensions based on the size of the wireless antennas inside of the enclosure. The location of the antenna window may also be based on a location of the wireless antennas within the enclosure.

In addition, a white carbon fiber pattern may be adhered over the carbon fiber enclosure with the antenna window to provide a clean appearance. The carbon fiber pattern may have the look and feel of real carbon fiber even though the pattern may be fabricated from plastic. The white carbon fiber pattern may allow the carbon fiber enclosure to be suitable and/or desirable for healthcare laptop applications.

Figure 1:
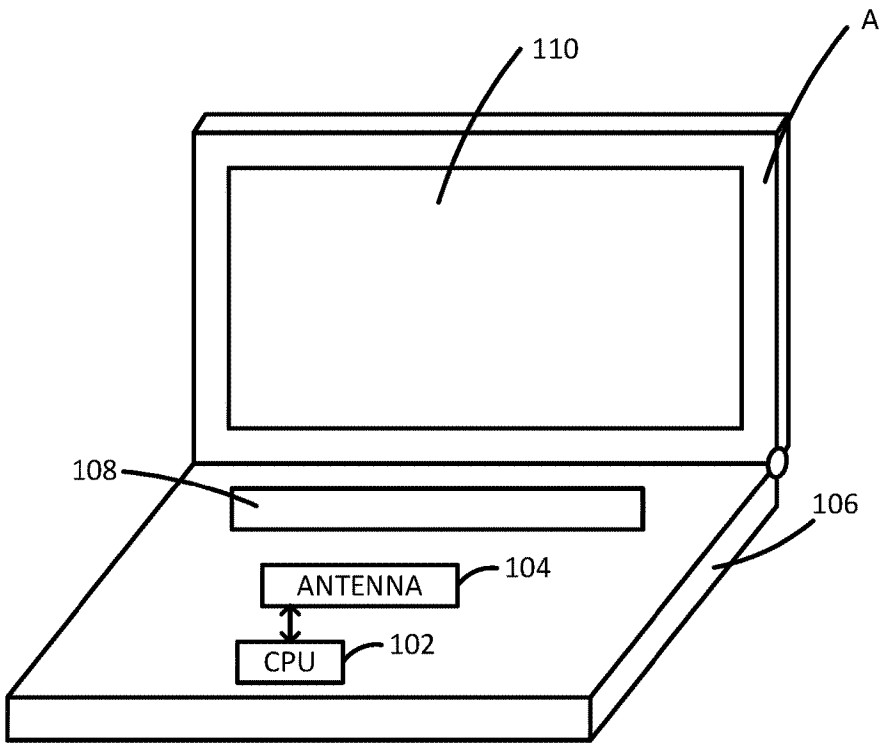
FIG. 1 is a block diagram of an example of an apparatus having a carbon fiber enclosure with an antenna window of the present disclosure.

FIG. 1 illustrates a block diagram of an apparatus 100 having a carbon fiber layer with an antenna window 108 of the present disclosure. The apparatus 100 may be any type of portable electronic device, such as a lap top computer, a tablet computer, a smartphone, and the like. The apparatus 100 may include a display 110 to provide a user interface.

The apparatus 100 may include a processor (e.g., a central processing unit (CPU)) 102 that is in communication with an antenna 104. The antenna 104 may be any type of wireless antenna. For example, the antenna 104 may be a Wi-Fi antenna, a Bluetooth radio, and the like. The antenna 104 may be deployed in various shapes and sizes. For example, the antenna 104 may have a coil structure, a printed dipole or monopole structure, a helical antenna structure, a wire structure, a patch structure, and the like. The antenna 104 may be a stand-alone component or be integrated into a printed circuit board as part of a larger component.

It should be noted that the apparatus 100 has been simplified for ease of explanation. The apparatus 100 may include additional electronic components that are not shown. For example, the apparatus 100 may include a non-transitory computer readable memory, network interface cards, graphics processors, a power supply, and the like.

In one example, the processor 102, the antenna 104, and any other components (not shown) may be enclosed by a housing 106. In one example, the housing 106 may be a carbon fiber enclosure with a layer of carbon fiber and a layer of a carbon fiber pattern adhered to the carbon fiber. As noted above, carbon fiber may be conductive. When the antenna 104 is enclosed by a conductive material, the conductive material may block, interfere with, or reduce, the wireless signal strength of the antenna 104.

In one example, an antenna window 108 may be formed in the housing 106. The antenna window 108 may provide a path for wireless signals from the antenna 104 to pass through the housing 106 without interference or without the wireless signals being blocked or reduced by the housing 106, or a portion thereof. In other words, even if the housing 106 is fabricated from a conductive material, such as a carbon fiber, the antenna 104 may operate as intended. As a result, the antenna 104 may operate at maximum efficiency as intended without any blocking or interference from the housing 106.

In one example, the antenna window 108 may be fabricated from a clear non-conductive material. For example, the antenna window 108 may be fabricated from a glass, a clear plastic (e.g., polycarbonate), and the like. The antenna window 108 may be injection molded into an opening that is cut into the housing 106. In one example, the antenna window 108 may be formed and coupled to the opening via a glue or adhesive. In one example, the antenna window 108 may be formed and mechanically coupled to the opening. For example, mechanical fasteners, clips, and the like, may be used to couple the antenna window 108 to the opening that is cut into the housing 106. In one example, the mechanical fasteners and clips may be molded into the housing 106.

The antenna window 108 may be located adjacent to, or over, the antenna 104. In some instances, the antenna window 108 may be located along a bezel of the housing 106. The antenna window 108 may be formed by using non-conductive materials for the keys that form the keyboard on the housing 106, or some keys that are located over the antenna 104. If the antenna 104 were located behind the display 110, the antenna window 108 may be located behind the display 110 or along a bezel of the display 110. In other words, the location of the antenna window 108 in the housing 106 may be a function of the location of the antenna 104. In addition, the dimensions of the antenna window 108 (e.g., the size and the shape) may be a function of the dimensions of the antenna 104. In other words, the antenna window 108 may be sized and shaped similar to the size and shape of the antenna 104.

Thus, the antenna window 108 may allow for clear transmission of wireless signals transmitted by the antenna 104. In addition, the antenna window 108 may allow for clear reception of incoming wireless signals transmitted to the antenna 104. The antenna window 108 may allow the antenna 104 to operate at maximum efficiency (e.g., maximum operating signal range).

Although FIG. 1 illustrates that the antenna 104 is in the lower portion of the housing 106 where the keyboard may be located, it should be noted that the antenna 104 may also be located in the "A" cover where the display 110 is located. Thus, when the antenna 104 is located in the "A" cover the antenna window 108 may be located in the "A" cover rather than the lower portion of the housing 106.

Figure 2:
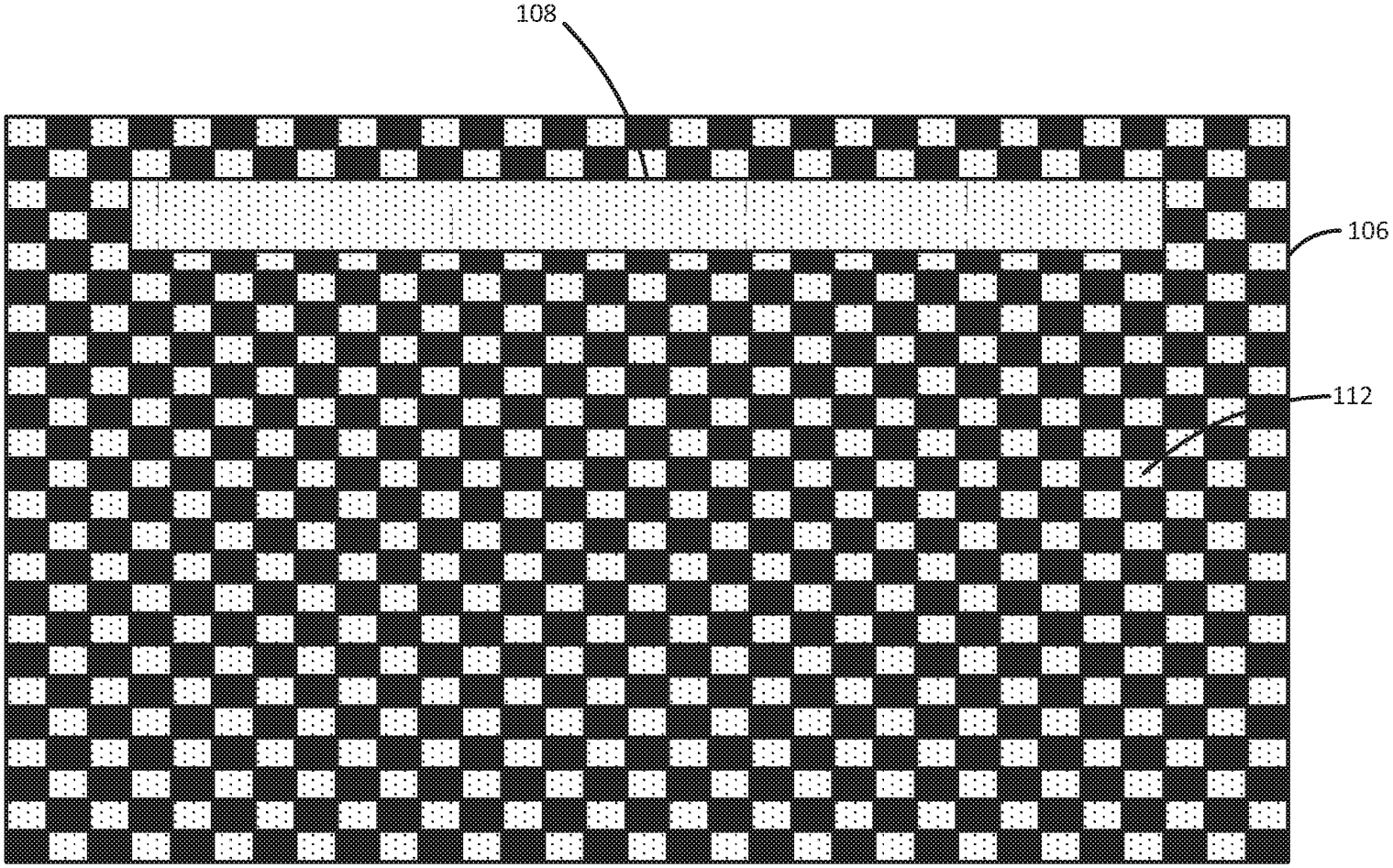
FIG. 2 is a top view of a carbon fiber layer with the antenna window of the present disclosure.

FIG. 2 illustrates a top view of an example housing 106. In one example, the housing 106 may be fabricated from a first layer comprising a carbon fiber material 112. The carbon fiber material 112 may be textured as desired for the apparatus 100.

As discussed above, an opening may be cut out of the carbon fiber material 112. The carbon fiber material 112 may be a unidirectional carbon fiber composite (e.g., the carbon fibers are all grown or extend in the same direction) or a multi-directional weaved carbon fiber composite (e.g., the carbon fibers are weaved in a perpendicular direction or cross-hatch pattern). The antenna window 108 may be injection molded into the opening cut out of the carbon fiber material 112.

As noted above, the antenna window 108 may be a function of the size and shape of the antenna 104. In FIG. 2 it is illustrated as a rectangular shape. However, the antenna window 108 may have any shape based on the antenna 104, such as, an "L" shape, a "T" shape, a rounded shape, a generally elongated shape, an irregular shape, and the like.

Figure 3:
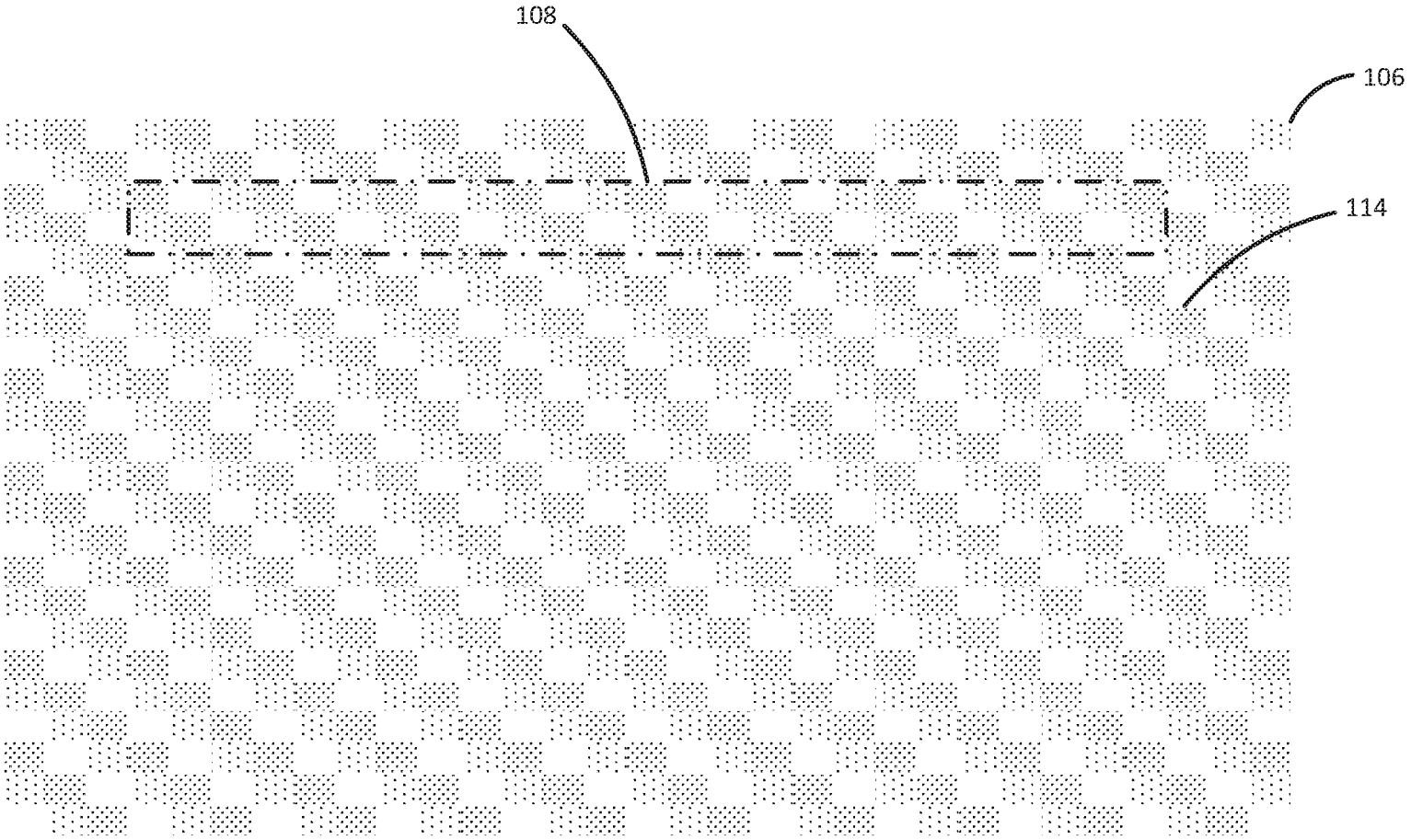
FIG. 3 is a top view of the carbon fiber layer with the carbon fiber pattern of the present disclosure.

FIG. 3 illustrates a top view of a second layer of the housing 106. The second layer of the housing 106 may be a decorative carbon fiber pattern 114 that is adhered to the carbon fiber material 112 illustrated in FIG. 2. In one example, an adhesive may be applied to the carbon fiber material 112 and the decorative carbon fiber pattern 114 may be applied on top of the adhesive. In one example, the decorative carbon fiber pattern 114 may be adhered to the carbon fiber material 112 via an out-mold decoration process. The carbon fiber pattern 114 may provide a smooth and/or visibly continuous surface that may be aesthetically desirable for housings of portable electronic devices.

In one example, the carbon fiber pattern 114 may have the appearance, texture, and feel of real carbon fiber. However, the carbon fiber pattern 114 may be fabricated from plastic. The carbon fiber pattern 114 may be any color. In one example, the carbon fiber pattern 114 may be white.

The carbon fiber pattern 114 may have a same shape and a same size as the first layer of the carbon fiber material 112. As illustrated in FIG. 3, the surface of the carbon fiber material 112 is not visible. The carbon fiber pattern 114 covers the entire area of the carbon fiber material 112. In addition, the antenna window 108 is hidden (as shown by dashed lines in FIG. 3) under the carbon fiber pattern 114.

Figure 4:
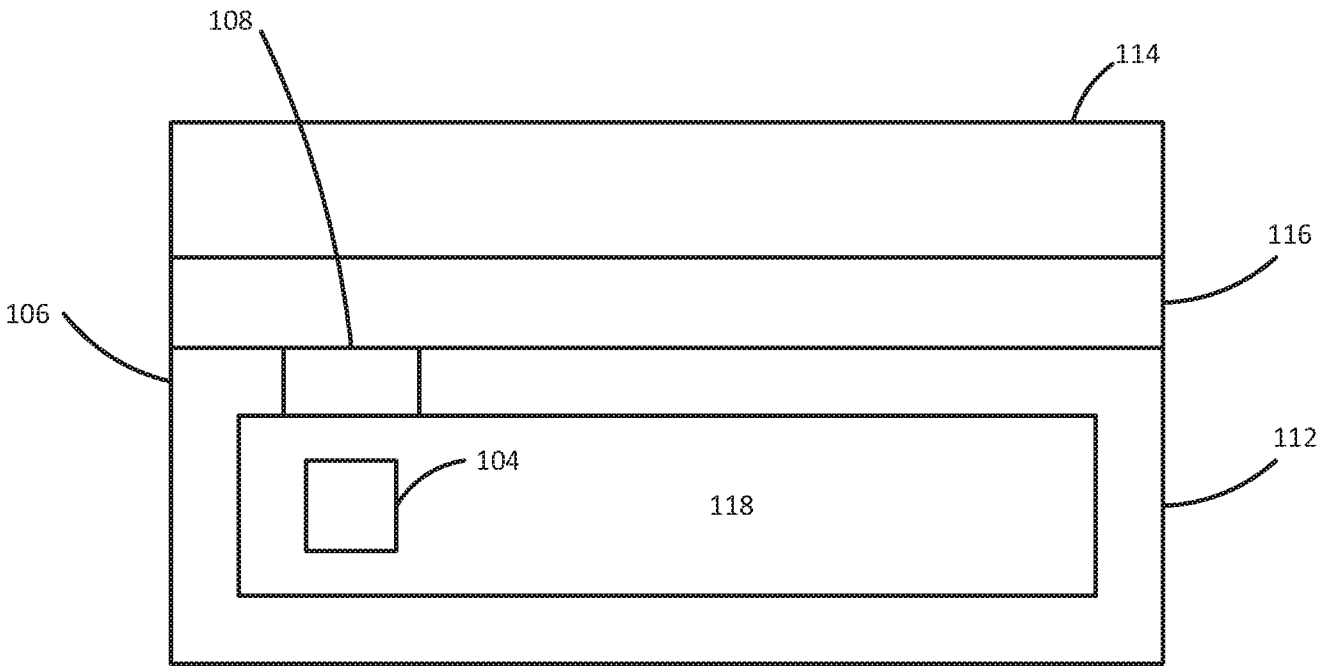
FIG. 4 is a side cross-sectional view of layers of the carbon fiber enclosure of the present disclosure.

FIG. 4 illustrates a side cross-sectional view of the example housing 106 of the apparatus 100. In one example, the carbon fiber material 112 may be formed to a desired shape of the housing 106, or a portion thereof, and have a volume 118 to enclose electronic devices. For example, the antenna 104 may be located inside of the volume 118 of the housing 106 and the carbon fiber material 112.

FIG. 4 illustrates an example of the antenna window 108 that is located adjacent to the antenna 104. For example, the antenna window 108 may be located over the antenna 104. As a result, the wireless signals transmitted from the antenna 104 may pass through the housing 106 via the antenna window 108 without interference or other negative effects. In other words, the antenna window 108 may allow the antenna 104 to clearly transmit and receive wireless signals.

In one example, an adhesive layer 116 may be applied between the first layer of the carbon fiber material 112 and the second layer of the carbon fiber pattern 114. The adhesive layer 116 may be any type of adhesive. In one example, the adhesive may be cured to couple the carbon fiber pattern 114 onto the carbon fiber material 112.

In one example, the adhesive layer 116 may be part of the carbon fiber material 112. In other words, the carbon fiber material 112 may be formed as a "sticker" that can be stuck on the carbon fiber material 112. In one example, the carbon fiber pattern 114 may be adhered to the carbon fiber material 112 via an out-mold decoration process or an in-mold decoration process.

In one example, the carbon fiber pattern 114 may be relatively thin compared to the carbon fiber material 112. For example, the carbon fiber pattern 114 may have a thickness that is less than a thickness of the carbon fiber material 112. The carbon fiber pattern 114 may have a thickness that is less than a millimeter and the carbon fiber material 112 may have a thickness that is several millimeters or centimeters thick.

Thus, the housing 106 for the apparatus 100 of the present disclosure provides a non-conductive signal path for wireless signals emitted by the antenna 104. In addition, the housing 106 provides the benefits (e.g., strength, light weight, easily workable, etc.) of using carbon fiber materials 112 to form the housing 106. The antenna window 108 eliminates the previous drawbacks to using carbon fiber materials 112 for the housing 106. In addition, the carbon fiber pattern 114 provides a finished clean cosmetic look that hides the antenna window 108, yet still provides the look and feel of carbon fiber to a user touching the exterior of the housing 106.

As noted above, the antenna window 108 may be located in the "A" cover with the display 110. When the antenna window 108 is located in the "A" cover, the "A" cover may also be designed with the carbon fiber materials 112 and the carbon fiber pattern 114, as described above or using the methods described below.

Figure 5:
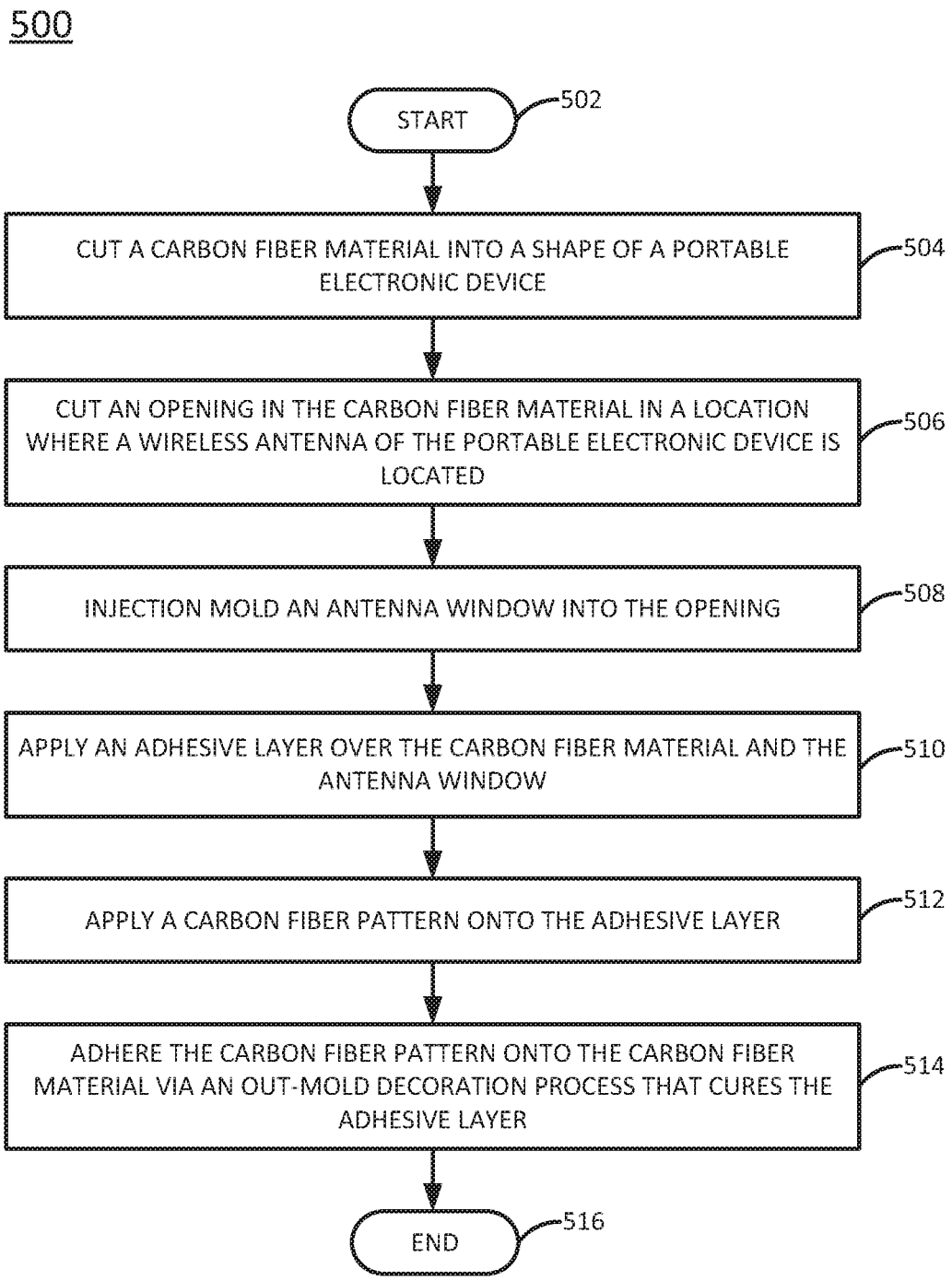
FIG. 5 is a flow chart of an example method for fabricating carbon fiber enclosure with an antenna window of the present disclosure.

FIG. 5 illustrates a flow diagram of an example method 500 for fabricating carbon fiber enclosure with an antenna window. In one example, the method 500 may be performed by control of a processor or controller that controls operations of different tools or machines in an assembly line.

At block 502, the method 500 begins. At block 504, the method 500 cuts a carbon fiber material into a shape of a portable electronic device. For example, a block of the carbon fiber may be provided and the carbon fiber may be cut to a desired shape and volume associated with a housing of the portable electronic device. In one example, the carbon fiber may be molded into a desired shape and volume to form a housing to enclose electronic components of the portable electronic device.

At block 506, the method 500 cuts an opening in the carbon fiber material in a location where a wireless antenna of the portable electronic device is located. In one example, the opening may be formed by cutting the carbon fiber material with a laser at a location where the antenna window will be located. In one example, the opening may be formed via molding process.

At block 508, the method 500 injection molds an antenna window into the opening. For example, antenna window may be formed from a non-conductive material such as a glass fiber or a plastic. An example of a plastic that may be used is polycarbonate. The glass or the plastic may be melted and set in the opening using any type of injection molding process.

At block 510, the method 500 applies an adhesive layer over the carbon fiber material and the antenna window. In one example, after the antenna window is set or hardened, an adhesive layer may be applied to the carbon fiber material and the antenna window Any type of adhesive material may be used.

At block 512, the method 500 applies a carbon fiber pattern onto the adhesive layer. In one example, the carbon fiber pattern may have a texture, look, and feel of real carbon fiber, but fabricated from plastic. The carbon fiber pattern may have any desired color. The carbon fiber pattern may have a same shape and a same size as the housing fabricated from the carbon fiber material.

At block 514, the method 500 adheres the carbon fiber pattern onto the carbon fiber material via an out-mold decoration process that cures the adhesive layer. For example, the out-mold decoration process may be used to apply heat and/or pressure to the adhesive layer. The adhesive layer may be cured to couple the carbon fiber pattern onto the carbon fiber material.

In one example, the out-mold decoration process may be used to provide any texture, shapes, designs, and the like, into the surface of the carbon fiber pattern and the carbon fiber material. In other words, the out-mold decoration process may be used to add a texture to the housing 106 and set the adhesive layer at the same time.

The finished housing may have an antenna window that allows an antenna to clearly transmit and receive wireless signals. In addition, the entire housing may have the feel and look of a carbon fiber enclosure that is desirable for certain applications. The housing may have the benefits of the antenna window to maximize operation of the antenna and the carbon fiber material to provide a lightweight strong housing material, yet have the carbon fiber pattern to hide the appearance of the antenna window.

In addition, the carbon fiber pattern may be easily decorated, colored, textured, and the like, compared to decorating, coloring, and texturing the actual carbon fiber material. At block 516, the method 500 ends.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An enclosure, comprising:

a first layer of carbon fiber that is formed in a shape of a portable electronic device;

an antenna window formed in the first layer of the carbon fiber, wherein the antenna window is laser cut into the first layer of carbon fiber; and a second layer of a carbon fiber pattern fabricated from a plastic, wherein the second layer has a same shape and a same size as the first layer of carbon fiber, and wherein the second layer is positioned to cover the first layer including the antenna window.

2. The enclosure of claim 1, wherein the first layer of carbon fiber comprises a unidirectional carbon fiber composite or a multi-directional weaved carbon fiber composite.

3. The enclosure of claim 1, wherein the antenna window is injection molded into an opening of the first layer of the carbon fiber.

4. The enclosure of claim 1, wherein the antenna window comprises a glass or a clear plastic.

5. The enclosure of claim 1, wherein the antenna window is located over a location of a wireless antenna of the portable electronic device.

6. The enclosure of claim 5, wherein a shape and a size of the antenna window is based on a shape and a size of the wireless antenna.

7. The enclosure of claim 1, wherein the second layer is adhered to the first layer of carbon fiber via out-mold decoration process.

8. An apparatus, comprising:

a wireless antenna;

a processor communicatively coupled to the wireless antenna; and an enclosure to enclose the wireless antenna and the processor, wherein the enclosure comprises:

a first layer of carbon fiber;

an antenna window formed in the first layer of the carbon fiber, wherein the antenna window is laser cut into the first layer of carbon fiber; and a second layer of a carbon fiber pattern fabricated from a plastic, wherein the second layer has a same shape and a same size as the first layer, and wherein the second layer is positioned to cover the first layer including the antenna window.

9. The apparatus of claim 8, wherein the antenna window is injection molded into an opening of the first layer of the carbon fiber.

10. The apparatus of claim 8, wherein the antenna window comprises polycarbonate.

11. The apparatus of claim 8, wherein the antenna window is located over a location of the wireless antenna of the portable electronic device.

12. The apparatus of claim 8, enclosure further comprises:

an adhesive layer between the first layer and the second layer, wherein the adhesive layer is cured via an out-mold decoration process.

13. A method, comprising:

cutting a carbon fiber material into a shape of a portable electronic device;

cutting an opening in the carbon fiber material in a location where a wireless antenna of the portable electronic device is located, wherein the cutting the opening is performed via a laser cutting operation;

injection molding an antenna window into the opening;

applying an adhesive layer over the carbon fiber material and the antenna window;

applying a carbon fiber pattern onto the adhesive layer, so that the carbon fiber pattern covers the carbon fiber material and the antenna window; and adhering the carbon fiber pattern onto the carbon fiber material via an out-mold decoration process that cures the adhesive layer.

14. The method of claim 13, wherein the injection molding is performed with a glass fiber or a plastic.

15. The apparatus of claim 8, wherein the antenna window comprises at least one of a rectangular shape, a "T" shape, or an "L" shape.

16. The enclosure of claim 1, further comprising:

an adhesive layer applied between the first layer of carbon fiber and the second layer.

17. The enclosure of claim 16, wherein the adhesive layer is cured to couple the second layer onto the first layer of carbon fiber.

18. The enclosure of claim 1, wherein the adhesive layer is formed as part of the first layer of carbon fiber.

* * * * *